US007886407B2

(12) United States Patent
Resnik et al.

(10) Patent No.: US 7,886,407 B2
(45) Date of Patent: Feb. 15, 2011

(54) HINGE ARRANGEMENT

(75) Inventors: Corinne Resnik, Altdorf (DE); Josef Hecht, Erlenmoos (DE); Dietmar Blersch, Ertingen (DE)

(73) Assignees: SUSPA GmbH, Altdorf (DE); Liebherr-Hausgeräte-Ochsenhausen, Ochsenhausen (DE)

( * ) Notice: Subject to any disclaimer, the term of this patent is extended or adjusted under 35 U.S.C. 154(b) by 163 days.

(21) Appl. No.: 11/909,904

(22) PCT Filed: Apr. 24, 2006

(86) PCT No.: PCT/EP2006/003742

§ 371 (c)(1),
(2), (4) Date: Sep. 27, 2007

(87) PCT Pub. No.: WO2006/114255

PCT Pub. Date: Nov. 2, 2006

(65) Prior Publication Data

US 2008/0189906 A1 Aug. 14, 2008

(30) Foreign Application Priority Data

Apr. 26, 2005 (DE) ..... 10 2005 019 325

(51) Int. Cl.
*E05F 1/08* (2006.01)

(52) U.S. Cl. ..... 16/286

(58) Field of Classification Search ..... 16/286, 16/277, 282, 287–291, 356, 370, 371; 312/325, 312/319.1, 319.2, 322, 323; 49/345; 296/146.12, 296/100.08; 180/69.2

See application file for complete search history.

(56) References Cited

U.S. PATENT DOCUMENTS

| | | | | |
|---|---|---|---|---|
| 678,790 | A * | 7/1901 | Nushawg et al. | 16/66 |
| 2,596,676 | A * | 5/1952 | Goderez | 16/52 |
| 2,674,761 | A * | 4/1954 | Harold | 16/288 |
| 3,516,095 | A * | 6/1970 | Clifton et. al. | 4/246.5 |
| 3,708,862 | A | 1/1973 | Powell, Jr. | |
| 5,271,652 | A * | 12/1993 | Watanabe et al. | 296/36 |
| 5,410,971 | A * | 5/1995 | Golden et al. | 108/6 |
| 6,038,986 | A * | 3/2000 | Ransil et al. | 108/145 |
| 6,397,434 | B1 * | 6/2002 | Cheal et al. | 16/370 |
| 6,499,189 | B2 * | 12/2002 | Kondo et al. | 16/289 |
| 6,789,293 | B2 * | 9/2004 | Habegger et al. | 16/343 |
| 6,845,545 | B2 * | 1/2005 | Han et al. | 16/277 |
| 6,991,199 | B2 * | 1/2006 | Carpentier | 248/122.1 |
| 7,228,949 | B2 * | 6/2007 | Namiki et al. | 188/381 |
| 2003/0217436 | A1 * | 11/2003 | Hashim et al. | 16/286 |
| 2003/0229965 | A1 | 12/2003 | Wang | |

(Continued)

FOREIGN PATENT DOCUMENTS

DE 20102998 U1 7/2001

(Continued)

*Primary Examiner*—Victor Batson
*Assistant Examiner*—Matthew Sullivan
(74) *Attorney, Agent, or Firm*—Browdy and Neimark, PLLC

(57) ABSTRACT

The invention relates to a hinge arrangement, in particular refrigerator housing comprising a refrigerator door pivotably articulated thereto, with a first part, with a second part pivotably articulated to the first part via a hinge, with a piston cylinder damping unit, which is operatively arranged between the first part and the second part for damping a pivoting movement of the two parts relative to one another, and which is articulated to at least one part.

13 Claims, 10 Drawing Sheets

U.S. PATENT DOCUMENTS

| | | | | |
|---|---|---|---|---|
| 2004/0040118 | A1 | 3/2004 | Han | |
| 2005/0155179 | A1 | 7/2005 | Duffy | |
| 2005/0173943 | A1* | 8/2005 | Duffy | 296/146.12 |
| 2005/0177980 | A1 | 8/2005 | Herper | |
| 2007/0035149 | A1* | 2/2007 | Charon et al. | 296/56 |

FOREIGN PATENT DOCUMENTS

| | | | |
|---|---|---|---|
| DE | 20207036 | U1 | 10/2003 |
| DE | 10355444 | A1 | 6/2005 |
| EP | 1375797 | A1 | 2/2004 |
| GB | 1252757 | A | 11/1971 |
| WO | 2004023580 | A1 | 9/2004 |

* cited by examiner

HINGE ARRANGEMENT

BACKGROUND OF THE INVENTION

1. Field of Invention

The invention relates to a hinge arrangement, in particular to a refrigerator housing comprising a refrigerator door pivotably articulated thereto via a hinge.

2. Background Art

A stop damper for a refrigerator door is known from DE 203 06 043 U1. When opening the refrigerator door, however, from a specific opening angle the door is no longer connected to the damper. The door may, therefore, in the opened state bear against an adjacent wall, for example. Conversely, when closing the door, the door is only connected to the damper from a specific closure angle. As the weight of refrigerator doors is extremely variable, the known damping is unsatisfactory.

The object of the invention is to provide a hinge arrangement in which the drawbacks of the prior art are overcome.

SUMMARY OF THE INVENTION

The object is achieved by. a hinge arrangement, in particular refrigerator housing comprising a refrigerator door pivotably articulated thereto, comprising a first part, a second part pivotably articulated to the first part via a hinge, a piston cylinder damping unit, which is operatively arranged between the first part and the second part for damping a pivoting movement of the two parts relative to one another, and which is articulated to at least one part. The essence of the invention is to damp the pivoting motion of two parts articulated to one another, such that a piston cylinder damping unit is provided which is directly articulated to at least one part. The damping characteristic of the piston cylinder damping unit may be adjusted much more easily than, for example, that of spiral springs which are frequently used in hinges.

Additional features and details of the invention are revealed from the description of a plurality of embodiments with reference to the drawings.

DESCRIPTION OF THE PREFERRED EMBODIMENTS

Figure 1:
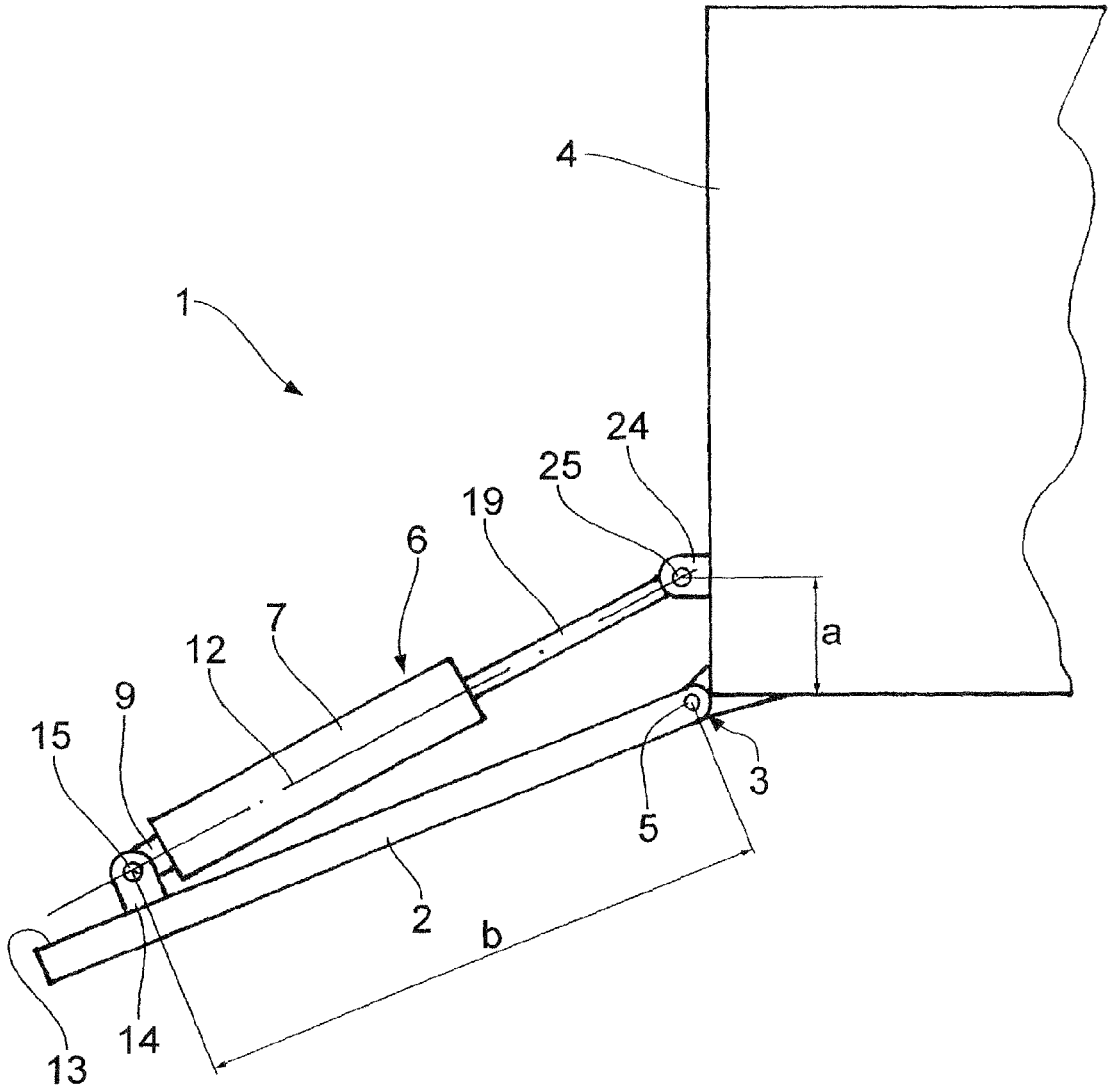
FIG. 1 shows a view of a hinge arrangement according to a first embodiment comprising a piston cylinder damping unit.

A first embodiment of the invention is disclosed hereinafter with reference to FIG. 1 to 4. In a hinge arrangement 1 according to the invention a first part, a refrigerator door 2, is pivotably articulated via hinges 3 to a second part, a refrigerator housing 4, only partially shown. The hinge 3 comprises a vertical pivot axis 5. In practice, a plurality of hinges 3 are frequently arranged above one another, at least at the upper and lower edge of the refrigerator door 2, which have a common pivot axis 5.

For damping the opening and closing motion of the refrigerator door 2 a damper 6 is provided, also denoted as a piston cylinder damping unit. Said damper comprises a substantially cylindrical housing 7 which at one end is closed by a base 8 formed integrally with the housing 7. On said base 8 a fastening element 9 is formed which is provided with a bore 10, the axis 11 of which extending perpendicular to the central longitudinal axis 12 of the housing 7 and intersecting said central longitudinal axis. On the inside 13 of the refrigerator door 2, a hinge element 14 with a corresponding bore is fastened, the fastening element 9 being connected in an articulated manner to the hinge element 14 by inserting a pin 15.

The housing 7 comprises a similarly cylindrical inner space 16 which extends concentrically to the axis 12 and at one end is closed by the base 8. The inner space 16 is defined in the radial direction by the internal wall 17 of the housing 7. At its other end, the housing 7 comprises an outwardly open aperture 8. A piston rod 19 is displaceably arranged in the inner space 16 in the direction of the axis 12, also concentrically to the axis 12, one end thereof 20 projecting from the housing 7 through the aperture 18. At this end 20, a further fastening element 21 is attached which also comprises a bore 22, the axis 23 thereof extending perpendicular to the central longitudinal axis 12 and intersecting said central longitudinal axis. On the refrigerator housing 4 a corresponding hinge element 24 with a corresponding bore is fastened, the fastening element 21 being connected in an articulated manner to the hinge element 24 by inserting a pin 25. The distance of the hinge element 24 from the pivot axis 5 is denoted by a. The distance of the hinge element 14 from the pivot axis 5 is denoted by b. The fixed articulation of the damper 6 to the door 2, on the one hand, and to the housing 4, on the other hand, is carried out such that the damper 6 projects as little as possible from the door 2 in the direction of the enclosed space, b is thus greater than a. The damper 6 may be arranged on the upper edge and on the lower edge of the door 2.

Figure 2:
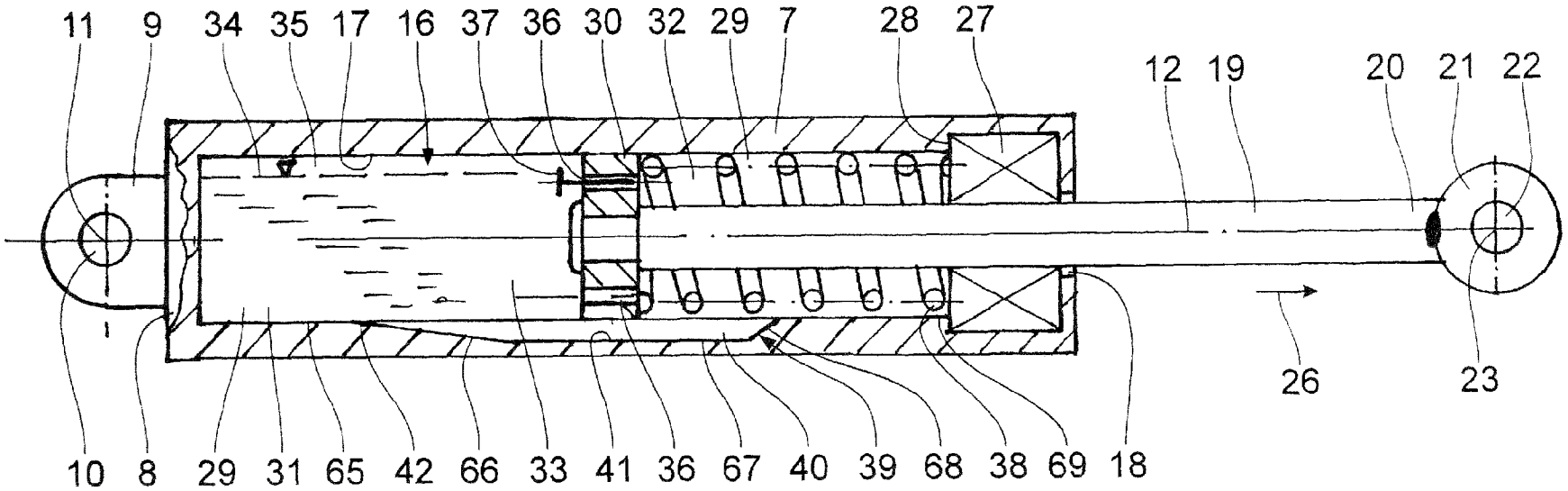
FIG. 2 shows a central longitudinal section of the piston cylinder damping unit according to FIG. 1.

Hereinafter, the construction of the damper 6 is explained in more detail by referring to FIG. 2. The damper 6 has a withdrawal direction 26 extending parallel to the central longitudinal axis 12. In the region of the end of the inner space 16 located in the direction 26, a guide/sealing bush 27 is secured in the housing 7 through which the piston rod 19 is displaceably outwardly guided. The bush 27 is surrounded in the radial direction and in the direction 26 by the housing 7 and secured thereby. It is located in an annular groove 28 arranged in the internal wall 17, whereby the bush 27 is also secured counter to the direction 26. Between the end of the bush 27, located counter to the direction 26, and the base 8 a working space 29 is formed. In the working space 29 is located a piston 30, sealingly bearing against the internal wall 17 and displaceable along the axis 12, which is fastened to the end of the piston rod 19 on the inside of the housing. The piston 30 divides the working space 29 into a partial working space 31 facing the base 8 as well as a partial working space 32 facing the bush 27. The working space 29 is, for the most part however, not completely filled with a damping fluid 33, in particular oil. The level is indicated by the reference numeral 34. A gas 35, in particular air, is located above the oil level 34.

The piston 30 comprises damping bores 36 distributed over its periphery and penetrating said piston in the direction 26, which connect the two partial working spaces 31 and 32 to one another. The damping bores 36 are partially closed by valves 37 which, with a movement in the direction 26, are open and, with a movement counter to the direction 26, are closed. A return spring 38 configured as a spiral spring and concentrically surrounding the piston rod 19 is arranged between the piston 30 and the bush 27. Said return spring is pretensioned, such that it pushes the piston 30 back into the housing 7 when the piston rod 19 is withdrawn, counter to the direction 26. In the internal wall 17 a plurality of longitudinal grooves 39 are distributed uniformly over the periphery. In the region of said longitudinal grooves 39, the piston 30 does not bear sealingly against the internal wall 17. However, a channel 40 is formed between the piston 30 and the base 41 of the longitudinal groove 39. Extending from the base 8, a portion 65 is initially present along which no longitudinal groove is provided. A portion 66 is attached thereto along which the cross-section of the longitudinal groove 39 in the direction 26 constantly increases from zero. A portion 67 is attached thereto along which the longitudinal groove 39 has a substantially constant cross-section. A portion 68 follows, along which the cross-section of the longitudinal groove decreases over a short length to zero. A portion 69 is attached thereto, along which no longitudinal groove is present. The flow cross-section of the bores 36 which is effective when extending the piston 30 in the direction 26, is substantially greater than the maximum cross-section of all longitudinal grooves 39 in the portion 67, so that the bores 36 define the flow resistance. Moreover, the effective flow cross-section of the piston 30 counter to the direction 26 is substantially smaller than the flow cross-section of the piston during a movement in the direction 26, so that the presence of the longitudinal grooves 39 thus plays a role.

Figure 3:
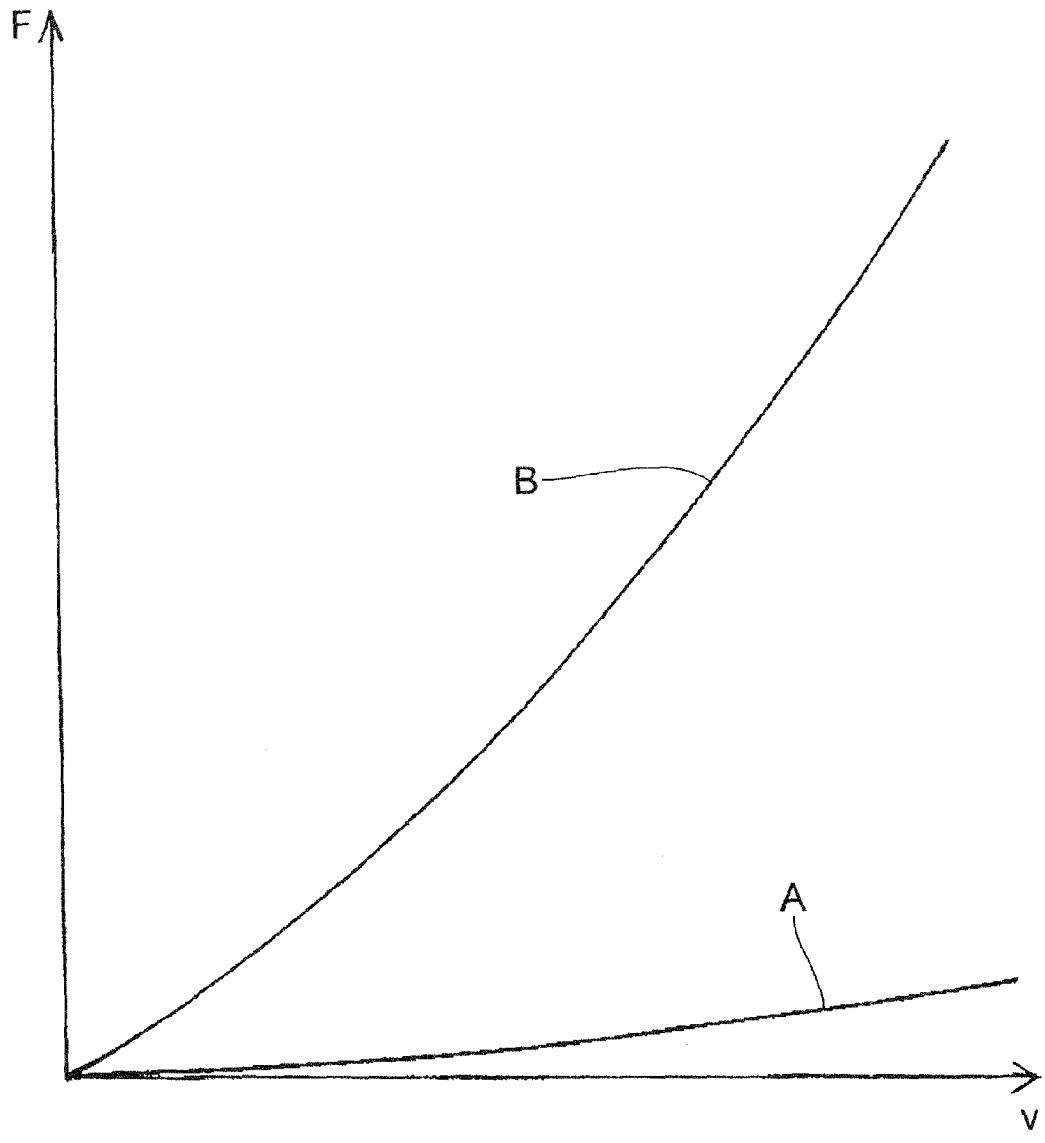
FIG. 3 shows force/velocity characteristic curves of the piston cylinder damping unit according to FIG. 2 for two different piston positions.

The characteristic curves of the dampers 6 are described hereinafter with reference to FIGS. 3 and 4. FIG. 3 shows the force/velocity characteristic curve of the damper 6 for two different cases. The withdrawal force F is shown as a function of the velocity v. Two cases A and B are compared. A relates to the characteristic curve in which the piston 30 is located in the portion in which the longitudinal grooves 39 are arranged. If the piston rod 19 is withdrawn in the direction 26, the piston 30 is displaced in the direction 26. The damping fluid 30 located in the partial working space 32 as well as the gas 35 located there are forced by the damping bores 36 into the partial working space 31. The damping behavior of the damper 6 is weak. The valves 37 are opened. The velocity dependency of the damping force is low and increases only slightly, which results from the velocity dependency of the flow resistance. The characteristic curve B shows the damping force when the piston 30 is located counter to the direction 26 behind the end 42 of the longitudinal grooves 39, i.e. outside the groove 39. Now the entire damping fluid 33 has to be forced through the damping bores 36 which are still open. The damping force is thus substantially greater at the same velocity because the cross-section available for the fluid 33 is substantially smaller.

Figure 4:
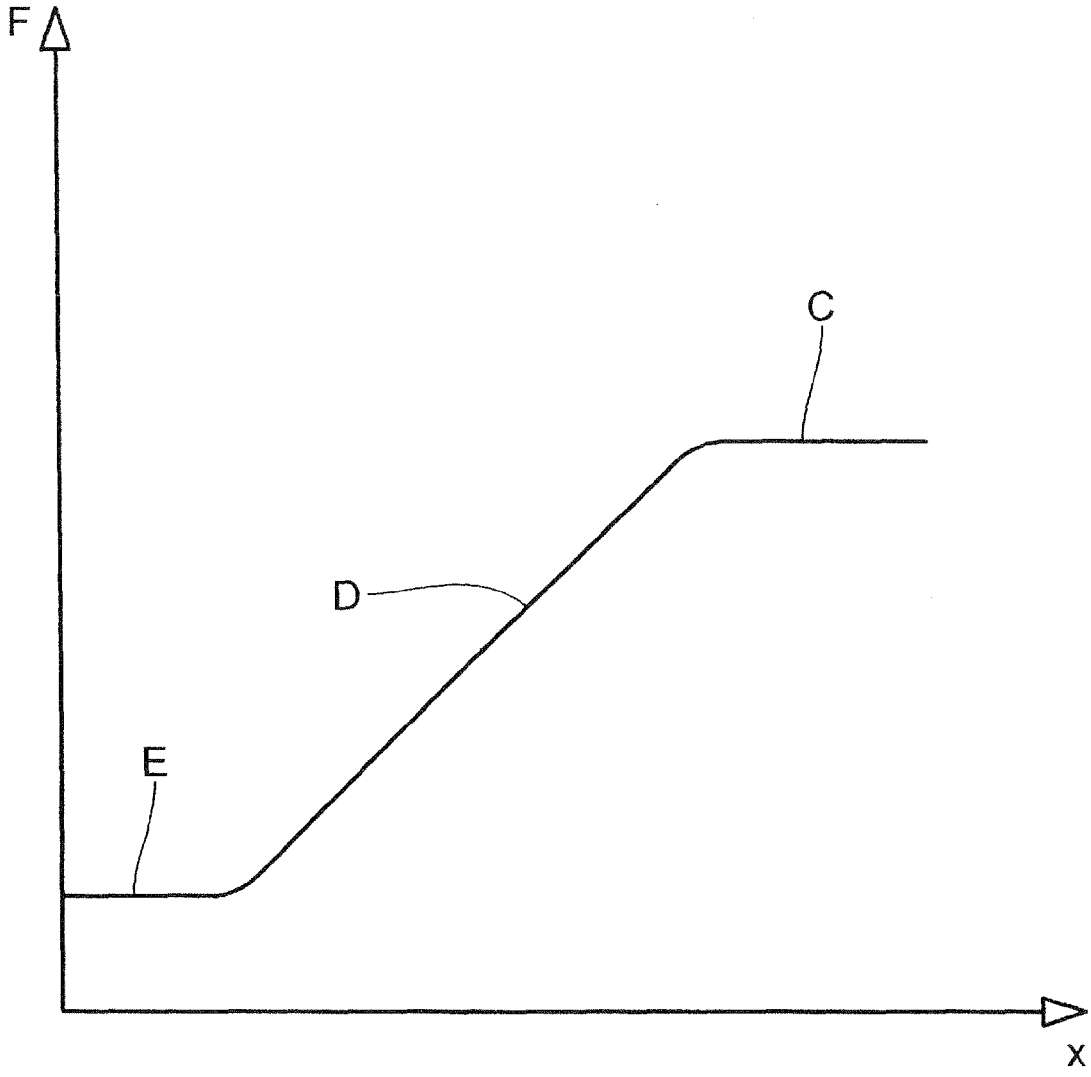
FIG. 4 shows a force/insertion characteristic curve of the piston cylinder damping unit according to FIG. 2 at constant insertion velocity.

FIG. 4 shows the damping force of the damper 6 at constant velocity when inserting the piston 30 counter to the direction 26. The x corresponds therefore, to an insertion depth. The characteristic curve has a first plateau region C where the damping force is high. Said region corresponds to the part where the piston 30 is located outside the longitudinal groove 39. The characteristic curve thus has a region D which alters in a linear manner. This corresponds to the region where the cross-section of the longitudinal grooves 39 continually alters. A further plateau portion E is attached to the portion D. Said plateau portion corresponds to the region where the cross-section of the longitudinal grooves 39 is entirely uniform.

The damping behavior of the refrigerator door 2 when opened and closed is disclosed hereinafter. It is assumed that the refrigerator door is initially closed. The piston rod 19 is in the inserted state. The piston 30 is located in the vicinity of the base 8. The return spring 38 is in the most relaxed state, in comparison with other states. The gas 35 is at atmospheric pressure. It is also possible to use gas 35 at overpressure. If the door is opened, the opening movement is only slightly damped, as the fluid 33 is able to flow through the relatively large damping bores 36. The valves 37 are opened. The opening of the door is therefore easy. The opening of the door is optionally assisted by the relaxing gas 35. The return spring 38 is, in turn, compressed. By the design of the bores 36 and the longitudinal grooves 39, the gas overpressure 35 and the spring characteristic of the return spring 38, the damping behavior may be adapted to refrigerator doors of different weights. Moreover, it may be ensured that the damping behavior is substantially the same, irrespective of whether the refrigerator door is heavily loaded, for example with bottles, or not.

The closing movement of the door is assisted by the return spring 38 which is now very compressed. By the design of the valves 37 it may be ensured that the damping, when closing the door, is greater than when opening the door. It is intended to be ensured that the door does not bear against the housing 4. This is also produced by the particular arrangement of the damper 6, as the damper 6 in the closed state of the door 2 extends almost parallel to the front of the housing 4 and thus the torque produced thereby is small. By means of the return spring 38, however, it is also ensured that the door is completely closed. The damping behavior of the piston 30 when inserting the piston rod 19 is substantially determined by the presence or absence of the longitudinal grooves 39. The flow cross-section of the piston 30 is substantially smaller when inserted counter to the direction 26 than in the opposite direction. Thus the cross-section added by the longitudinal groove 39 plays a substantial role. In the completely withdrawn state the piston 30, approximately as shown in FIG. 2, is still level with the portion 67. The damping behavior is thus relatively low, but still greater than when withdrawing the piston in the direction 26 at the same height. If the piston 30 reaches the portion 66, the cross-section of the longitudinal grooves 39 is reduced and the damping force increases in a linear manner. In the portion 65 the damping is at a maximum, as the longitudinal grooves 39 are no longer present. It is thus prevented that the refrigerator door 2 bears against the housing 4 when closed. The damping by the bores 36, which are effective during insertion, and the longitudinal grooves 39 is velocity-dependent and controlled by the grooves. The harder the door is pushed shut the greater the damping. Gentle and secure closing in different loading situations of the door 2 is thus always ensured. By the articulation of the damper 6 to the door 2 and the fact that b is substantially greater than a, when opening the door 2 the damper 6 is pivoted away from the operating range and visible range of the refrigerator housing 4. There are different degrees of damping forces of the damper 6, as already explained, in the closing and opening direction of the door 2. In the closing direction the damping forces relative to the velocity and closure angle are designed such that a gentle and secure closing of the door 2 in every loading situation is ensured. In the opening direction of the door 2 the damping is designed to be as low as possible.

Figure 5:
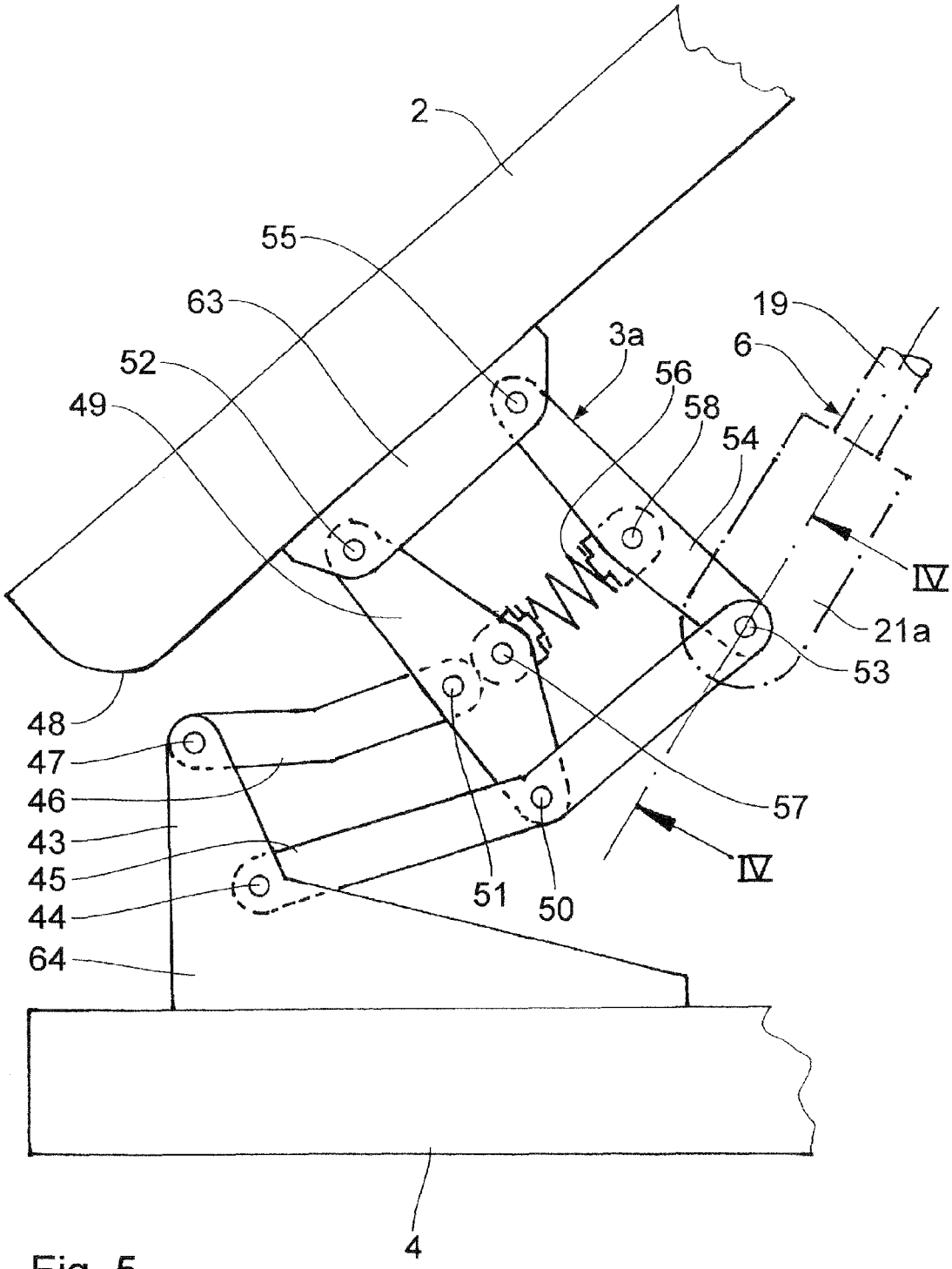
FIG. 5 shows a hinge arrangement according to a second embodiment in a central position.
Figure 6:
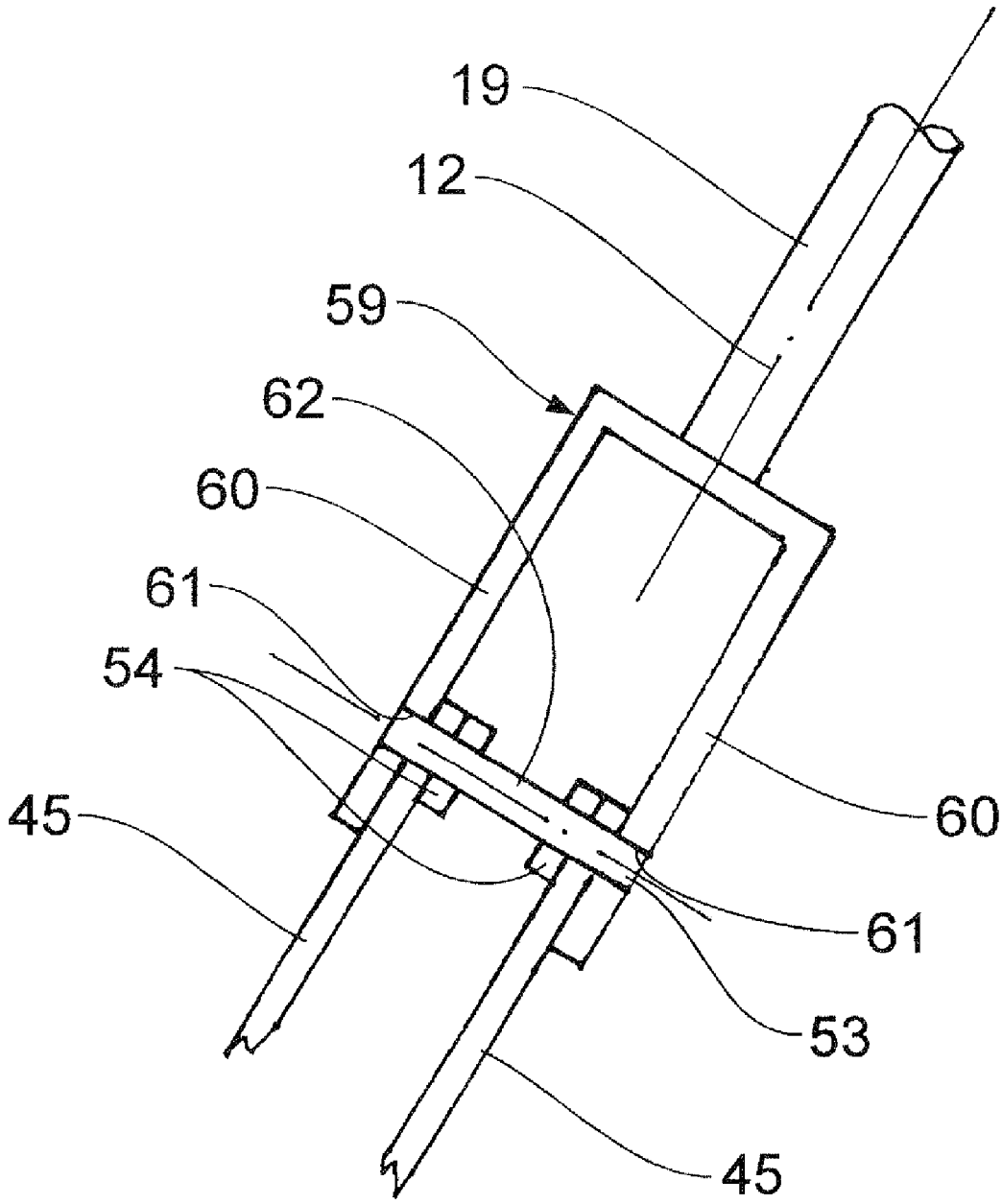
FIG. 6 shows a section according to the cutting line VI-VI in FIG. 5.

By referring to FIGS. 5 to 8 a second embodiment of the invention is disclosed hereinafter. Identical parts contain the same reference numerals as in the first embodiment, reference therefore being made to the description thereof. Structurally different parts, but parts which are functionally similar, contain the same reference numerals followed by the letter a. The main difference relative to the first embodiment is that the hinge 3*a* is a multi-jointed hinge, in particular a 7-joint hinge. Said 7-joint hinge has, relative to the first embodiment, the advantage that the door 2 when opened is guided over a dead centre point and thus the opening position and closing position of the door 2 represent stable end positions. Fittings 63, 64 are provided on the hinge 3*a* which are connected to the door 2 and/or the housing 4. All elements of the hinge 3*a* are formed from bent sheet metal with a substantially U-shaped cross-section. The hinge 3*a* is thus mirror symmetrical relative to a horizontally extending symmetrical plane. For simplicity, only one half of the hinge 3*a*, namely that located above the plane of symmetry, is shown. The hinge 3*a* consists substantially, and simply expressed, of a first parallelogram articulated to the fitting 64, to which a second parallelogram is articulated, to which in turn the fitting 63 is articulated. The fitting 64 in practice comprises a planar base body as well as a projection 43 projecting relative to the door 2. A central hinge arm 45 is pivotably fastened thereto via a joint 44. At the outer end of the projection 43—in FIG. 5 left of the joint 44 and more remote from the housing 4 than the joint 44—a support arm 46 is articulated via a joint 47. The support arm 46 does not extend in a straight line, but is bent in the direction of the door 2, so that it does not collide with the rounded edge 48 of the door 2 facing the housing 4 when opened. The arms 45 and 46 are both articulated to an intermediate plate 49 on adjacent joints 50 and 51. The hinge point 50 is located approximately in the centre of the central hinge arm 45, the arm 45 thus extends further beyond the joint 50. The intermediate plate 49 is of elongate configuration and widened in the middle. The joint 50 is located on the end facing the housing 4. The joint 51 is located approximately at half the distance between the joint 50 and the fitting 63 to which the intermediate plate 49 is articulated via a joint 52. The projection 43, the arms 45 and 46 as well as the intermediate plate 49 form with the joints 44, 47, 50, 51 a first four-point joint, approximately a parallelogram. On the end of the central hinge arm 45 remote from the housing 4, via a joint 53 an intermediate arm 54 is fastened in an articulated manner which at its other end is fastened to the fitting 63 via a joint 55. The hinge points 52, 50, 53, 55 form a second four-point joint which is articulated via the rigid central hinge arm 45, on the one hand, and via the support arm 46 fastened in an articulated manner to the second four-point joint, on the other hand. The joints 52, 50, 53, 55 also form approximately a parallelogram. It should be pointed out that this is only an approximation. The joint 50 is not located on a line extending through the joints 44 and 53 but outside thereof in the direction of the housing 4. The central hinge arm 45 is thus slightly angled in the direction of the door 2. Centrally between the joints 50 and 52, on the one hand, and the joints 53 and 55, on the other hand, a compression spring 56 is pivotably articulated via two joints 57, 58 to the intermediate plate 49 and/or the intermediate arm 54 respectively. In the region of the joint 57 the intermediate plate 49 has the aforementioned widened portion. The damper 6 is articulated to the joint 53 with its fastening element 21*a* fastened to the piston rod 19, which is shown in FIG. 6 in detail. To this ends, at the outer end of the piston rod 19 a fork 59 with two legs 60 is fastened. The fork 59 comprises corresponding latching openings 61 which are open transversely to the central longitudinal axis 12, by which the fork 59 is latched to a journal 62 forming the joint 53. The journal 62 is also guided through corresponding bores in the central hinge arm 45 and intermediate arm 54. It is also possible not to allow the articulation of the free end of the piston rod 19 to coincide with the joint 53. The articulation may also take place on the arm 45 in the direction of the joint 50 or on an extension to be provided therefor which extends outwardly over the joint 53. It is advantageous if the damper 6 is articulated to the central hinge arm 45 as the lever action produced thereby is particularly great. By the displacement of the articulation point of the fastening element 21*a* on the line between the joints 50 and 53, with the same damper 6, the torque produced may be altered. Thus, for example, the adaptation of the same damper 6 may be carried out on doors 2 of different sizes and thus different weights. The particularity of the central hinge arm 45 relative to the other arms of the 7-joint hinge is that the arm 45 is, at the same time, a component of the first four-point joint 44, 50, 51, 47 and the second four-point joint 50, 53, 55, 52. It is possible also to fasten the free end of the piston rod 19 to a metal sheet which is attached to the arm 45. As in the first embodiment, the damper 6 at its other end is approximately centrally articulated to the door 2, relative to the width of the door 2.

Figure 7:
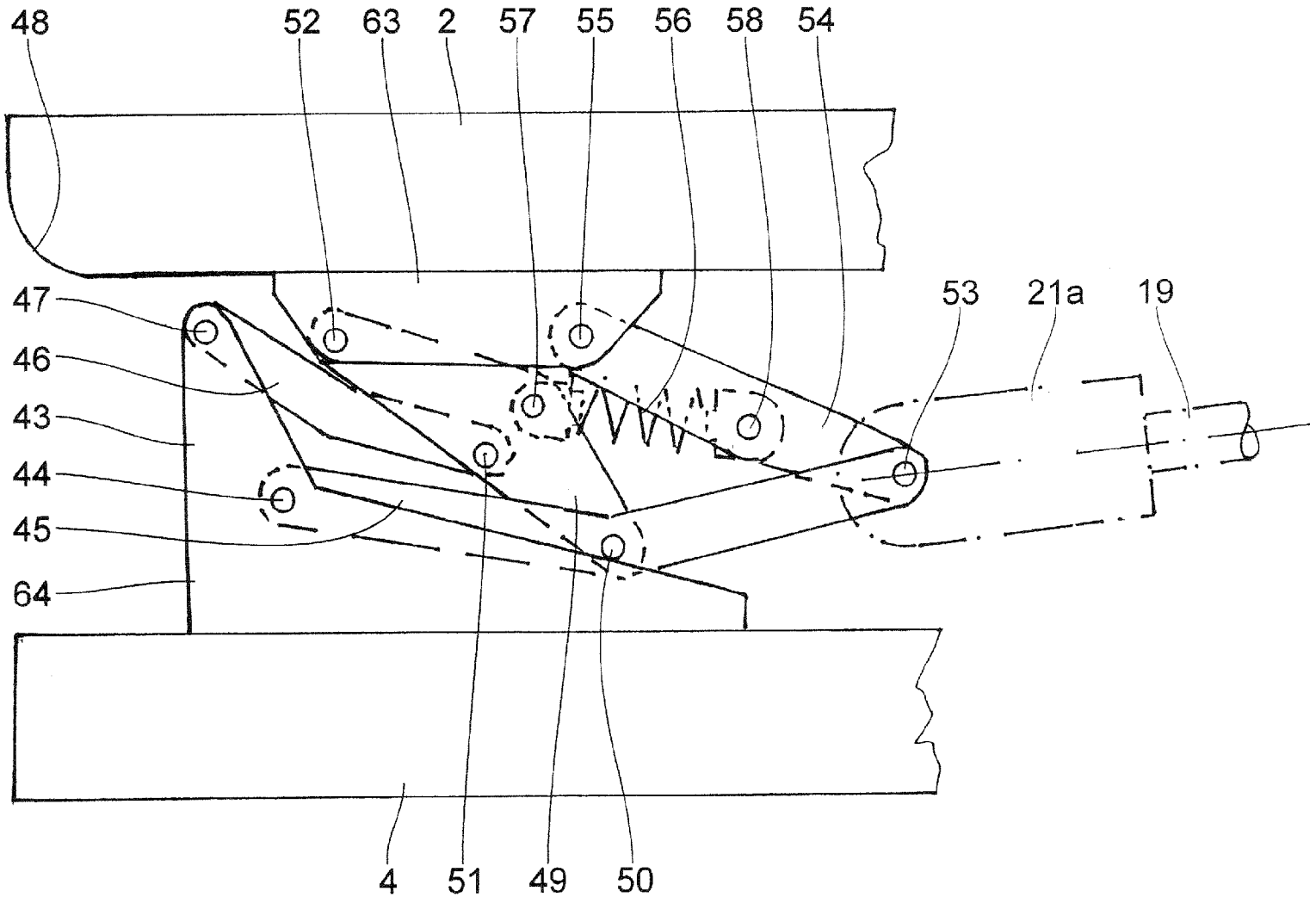
FIG. 7 shows the hinge arrangement according to FIG. 5 in a closed position.
Figure 8:
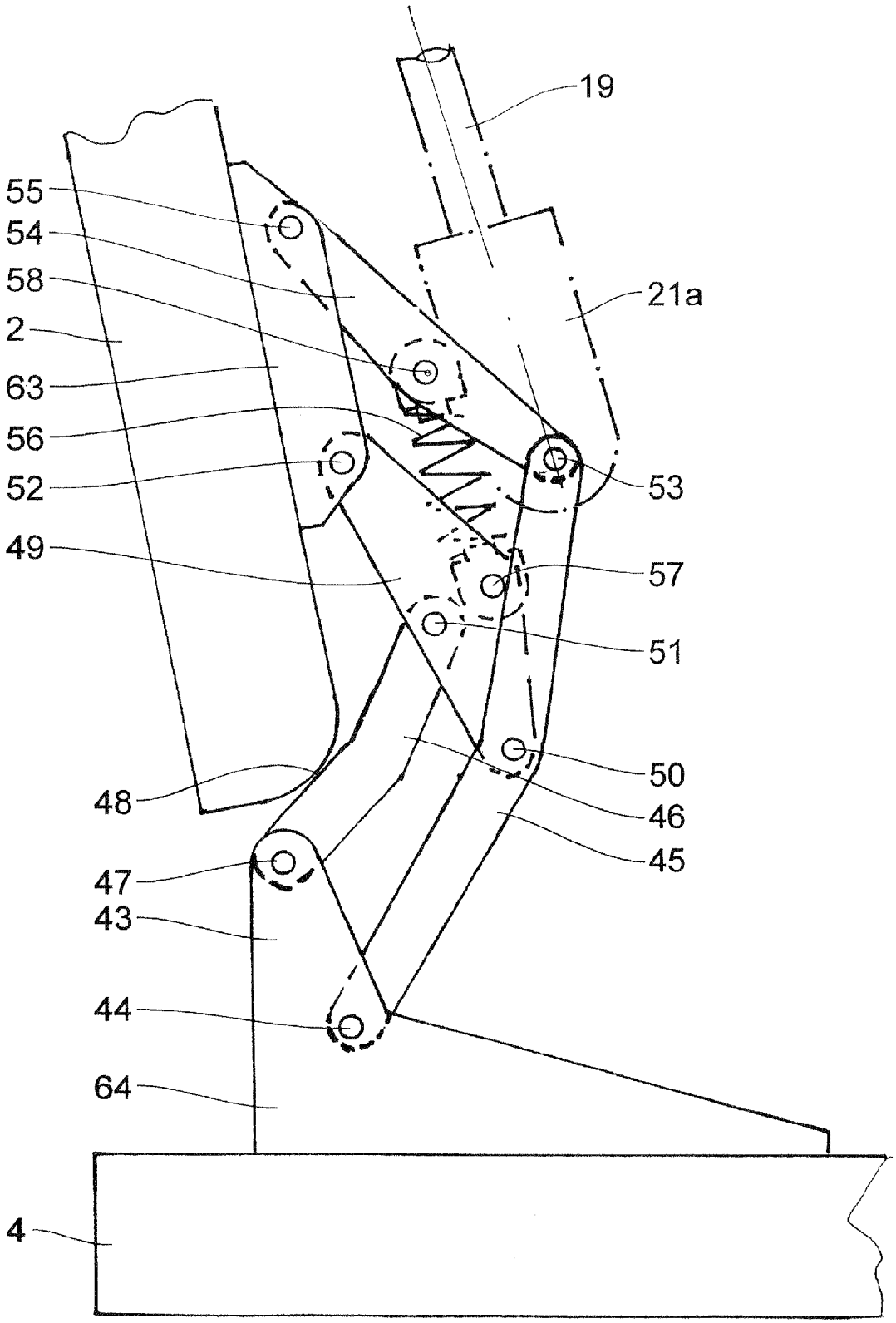
FIG. 8 shows the hinge arrangement according to FIG. 5 in an open position.

Hereinafter, by referring to FIGS. 5, 7 and 8, the dynamic of the hinge 3*a* is disclosed. In FIG. 5, the door 2 is shown in a central open position, for example at an opening angle of approximately 45°. This position represents the aforementioned dead centre point of the door. In this position, the distance between the joints 57 and 58, the articulation points of the compression spring 56, is minimal. A pivoting in the direction of the closed position shown in FIG. 7 or a pivoting in the open position shown in FIG. 8 leads to an increase in the distance between the hinge points 57 and 58, i.e. the compression spring 56 pushes the door 2 beyond the dead centre point either into the open position or into the closed position which are then respectively stable. In the closed position shown in FIG. 7, the two arms 45 and 46 are pivoted in the direction of the housing 4. The intermediate plate 49 and the intermediate arm 54 extend obliquely to the rear. The hinge 3*a* is thus folded up compactly and the compression spring 56, in comparison with the central position according to FIG. 5, is relatively relaxed. In the open position shown in FIG. 8, the two arms 45 and 46 are pivoted away from the fitting 64 to a maximum extent. The same applies to the intermediate plate 49 and the intermediate arm 54. The hinge 3*a*, therefore, has its maximum longitudinal extension. The rear edge 48 of the door 2 is removed to a maximum distance from the housing edge 4 facing said door, so that access to the inner space of the refrigerator and/or the door is possible in an optimal manner. The compression spring 56 is located in comparison with the position shown in FIG. 5 in a relatively relaxed state.

The opening and closing behavior of the door 2 is described hereinafter by including the damping characteristic of the damper 6. Before opening the door 2, the piston 30 is located in a maximum insertion position. When withdrawing the piston rod 19, the damping is minimal, as the relatively large bores 36 determine the damping behavior. The door 2 may thus be easily opened. From a defined opening angle, the door remains in the open position. In this case, the opening forces of the door hinge and the closing forces of the damper are compensated. When closing the door 2, the valves 37 are closed, the damping of the damper 6 is thus greater. The insertion of the piston rod 19 is simplified by the return spring 38. Beyond the dead centre point, the completely damped closing of the refrigerator door 2 is ensured by the compression spring 56, the return spring 38 and the increasing damping through the longitudinal grooves 39.

As already mentioned, it is possible, in principle, to attach the damper 6 both to the upper and also to the lower hinge 3*a* of the door 2. This may, for example, be useful, for example with tall refrigerators where the loading may be correspondingly higher. With appliances with double doors, for example refrigerators and freezer cabinets, two doors are arranged above one another. For said doors, if required, one respective damper, respectively two dampers or mixed versions may be used. As already mentioned, by the articulation of the damper 6 to the central hinge arm 45 the opening force to be applied when opening the door 2 is reduced. This may be explained by the fact that the damper 6 additionally supports the door 2 and thus reduces the frictional forces in the hinge 3*a*. The wear of the hinge 3*a* is thus reduced and the life of the hinge increases. A further important advantage of the arrangement of the damper 6 results from the approximately parallel arrangement of the damper to the door. As a result, it is avoided that when the door 2 is closed, too great a pressure is exerted on the door seal. This would, over a lengthy period of time, possibly lead to damage to the seal and thus to possible leakages.

Figure 9:
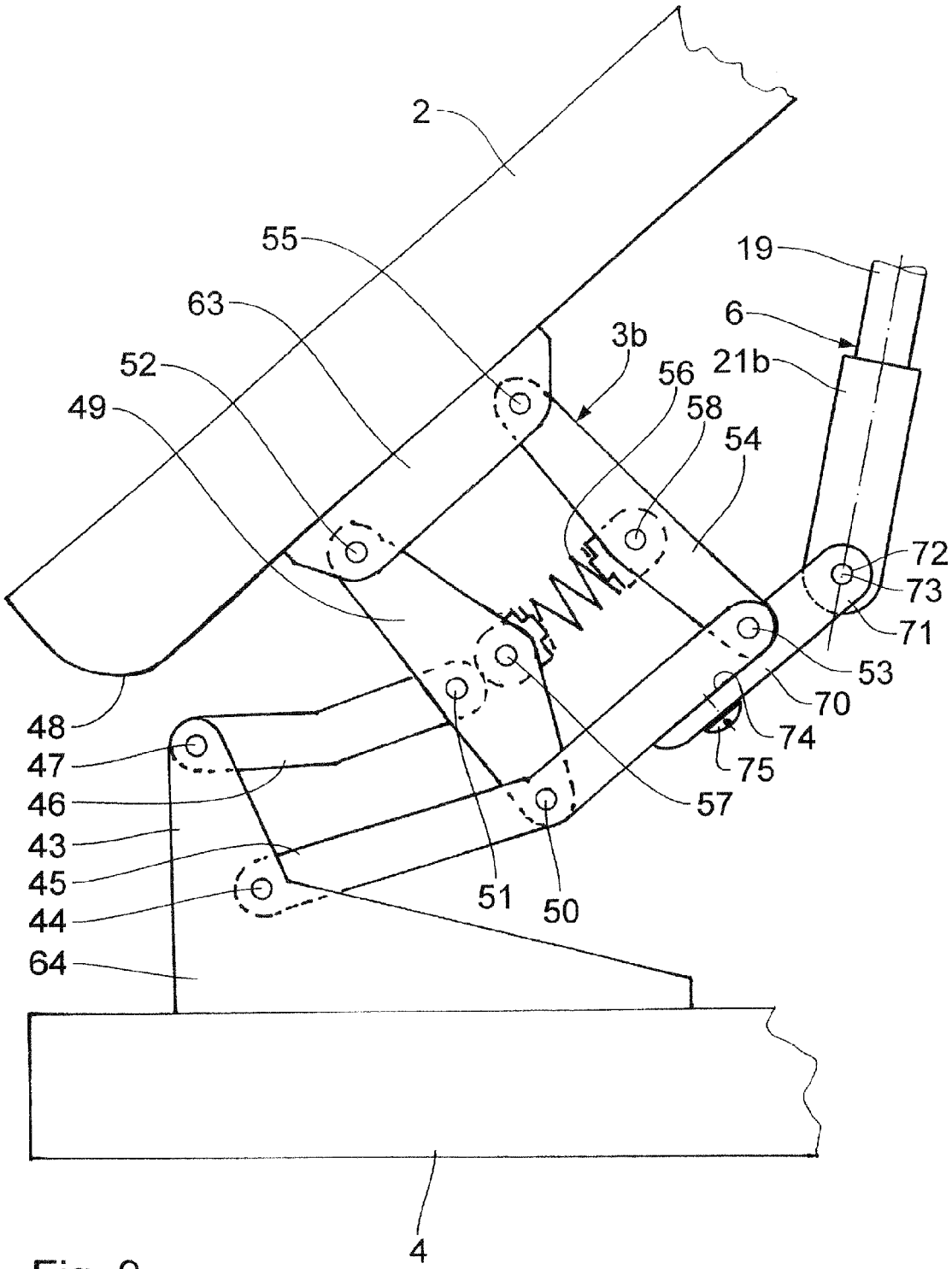
FIG. 9 shows a hinge arrangement according to a third embodiment in a central position and FIG. 10 shows a hinge arrangement according to a fourth embodiment in a central position.

A third embodiment of the invention is disclosed hereinafter with reference to FIG. 9. Identical parts contain the same reference numerals as in the second embodiment, reference being made to the description thereof. Structurally different but functionally similar parts contain the same reference numerals followed by the letter b. The essential difference relative to the second embodiment is in the articulation of the damper 6 to the hinge 3*b*. For attaching the fastening element 21*b* a separate fastening arm 70 is provided on the central hinge arm 45 in the region of the joint 53. The arm 70 at its outer end has the shape of a fork with two overlapping projections 71 spaced apart from one another. The projections 71 have aligned bores 72 through which a journal 73 is guided and secured there. At the other end, the fastening arm 70 comprises a bearing surface 74 adapted to the outer contour of the central hinge arm 45. In the present case, the fastening arm 70 is connected by a screw 75 to the central hinge arm 45. Further connection options such as riveting, welding, etc. may also be used. The fastening arm 70 has a smaller thickness perpendicular to the drawing plane shown in FIG. 9, than the hinge 3*b*. As a result, the fastening arm 70 does not project over the hinge 3*b*.

The fastening element 21*b* is configured as a rod-shaped head with a bore, through which the journal 73 is guided. The fastening element 21*b* is thus held between the two projections 71 and may be pivoted about the journal 73. It is advantageous in this embodiment that an already existing hinge may be used to which the damper 6 may be retrospectively attached. Instead of the bore in the fastening element 21, an outwardly guided slot in the form of a jaw may also be provided.

Figure 10:
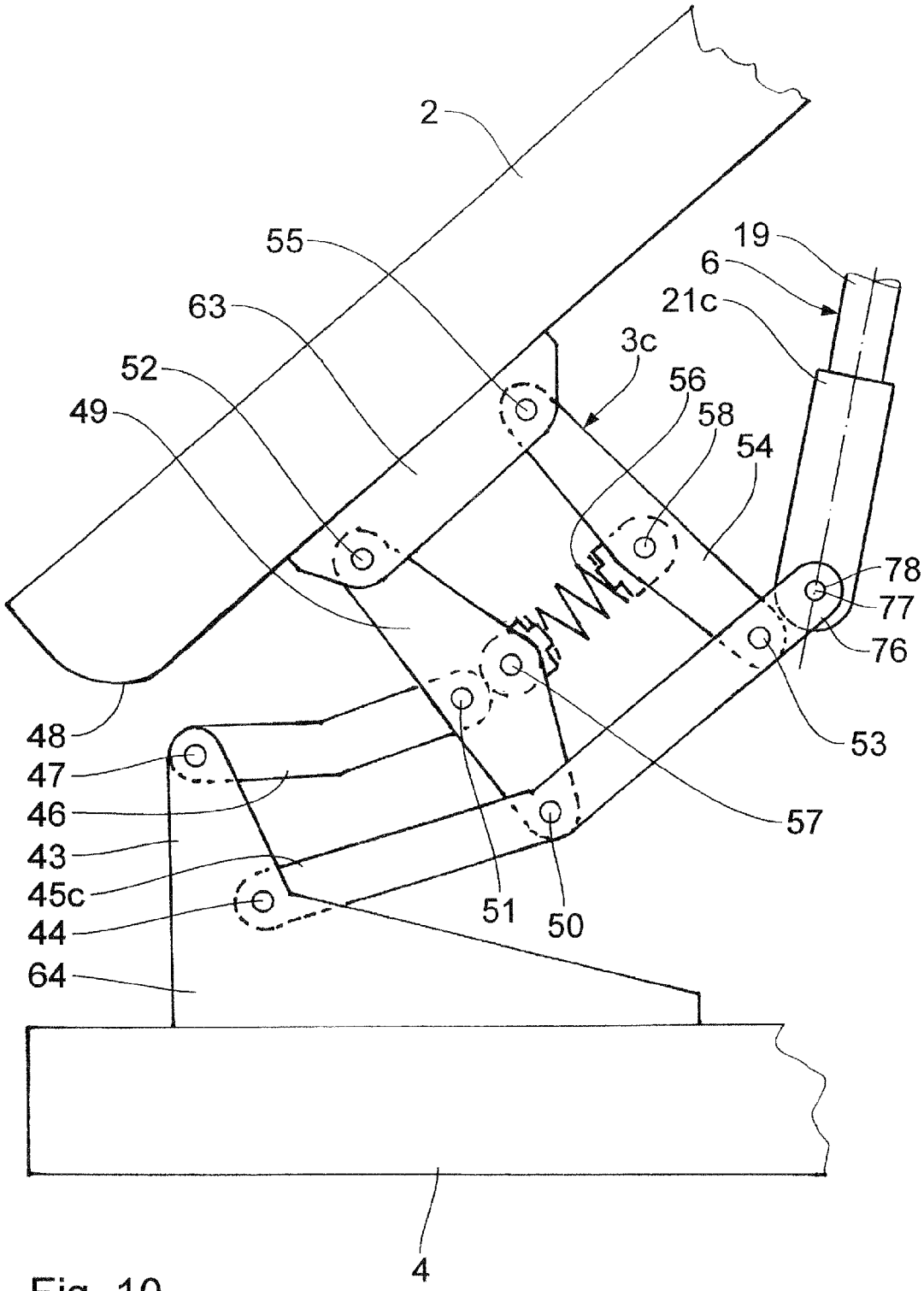

A fourth embodiment of the invention is disclosed hereinafter with reference to FIG. 10. Identical parts contain the same reference numerals as in the second embodiment, reference being made to the description thereof. Structurally different but functionally similar parts have the same reference numerals followed by the letter c. The essential difference relative to the second embodiment is in the articulation of the fastening element 21*c* to the central hinge arm 45*c*. Said central hinge arm is outwardly extended via the joint 53 and thus comprises a portion 76 projecting outwardly relative to the joint 53. As in the embodiment according to FIG. 9, the portion 76 consists of two projections arranged above one another, projecting in the shape of a fork with aligned bores 77 through which a journal 78 is guided and fastened there. The head-like fastening element 21*c* has a bore through which the journal 78 is guided. The element 21*c* is thus fixed between the projections and may be pivoted about the journal 78. It is advantageous in this embodiment relative to the second embodiment, that the joint 53 and the joint belonging to the journal 78, are disengaged from one another. Moreover, unlike in the third embodiment, an additional component in the form of the fastening arm 70 is not required.

The invention claimed is:

1. A hinge arrangement, comprising:

a. a first part (2), b. a second part (4) pivotably articulated to the first part (2) via a hinge (3; 3*a*; 3*b*; 3*c*), and c. a piston cylinder damping unit (6), i. which is operatively arranged between the first part (2) and the second part (4) for damping a pivoting movement of the two parts (2, 4) relative to one another, and ii. which is articulated to at least one of the first and the second part (2, 4), wherein d. a first fitting (64) and a second fitting (63) are connected to the first part (2) and to the second part (4), respectively, e. the hinge (3*a*; 3*b*; 3*c*) is a multi-jointed hinge, f. the hinge (3*a*; 3*b*; 3*c*) comprises a first four-point joint (44, 50, 51, 47) articulated to the first fitting (64), to which a second four-point joint (50, 53, 55, 52) is articulated, to which in turn the second fitting (63) is articulated, g. the piston cylinder damping unit (6) is articulated to a central hinge arm (45) of the multi-jointed hinge via a fastening arm (70), and h. the central hinge arm (45; 45*c*) is a component of the first four-point joint (44, 50, 51, 47) and of the second four-point joint (50, 53, 55, 52)

i. the hinge comprises the central hinge arm (45), a support arm (46), and a first intermediate arm (49), and j. one end of the first intermediate arm (49) connects to a middle portion of the central hinge arm (45), and a middle portion of the first intermediate arm (49) connects to one end of the support arm (46).

2. A hinge arrangement according to claim 1, wherein the piston cylinder damping unit (6) comprises a piston (30) displaceably guided in a housing (7), wherein the piston (30) divides a working space (29) into a first partial working space (31) and a second partial working space (32).

3. A hinge arrangement according to claim 2, wherein in the housing (7) a return spring (38) connected to the piston (30) is provided for returning the piston (30) from a withdrawn position into an initial position.

4. A hinge arrangement according to claim 3, wherein the working space (29) is partially filled by a damping fluid (33).

5. A hinge arrangement according to claim 4, wherein at least along one part of the internal wall (17) of the housing (7) at least one damping groove (39) is provided for altering the damping behavior.

6. A hinge arrangement according to claim 1, wherein the central hinge arm (45; 45*c*) is indirectly articulated to at least one of the first and the second part (2, 4).

7. A hinge arrangement according to claim 6, wherein the central hinge arm (45; 45*c*) is directly articulated to the second part (4) via a joint (44).

8. A hinge arrangement according to claim 7, wherein the central hinge arm (45; 45*c*) is articulated to the first part (2) via at least one separate arm (49, 54).

9. A hinge arrangement, comprising:

a. a first part (2), b. a second part (4) pivotably articulated to the first part (2) via a hinge (3; 3*a*; 3*b*; 3*c*), and c. a piston cylinder damping unit (6), i. which is operatively arranged between the first part (2) and the second part (4) for damping a pivoting movement of the two parts (2, 4) relative to one another, and ii. which is articulated to at least one of the first and the second part (2, 4), wherein d. a first fitting (63) and a second fitting (64) are connected to the first part (2) and to the second part (4), respectively, e. the hinge (3*a*; 3*b*; 3*c*) is a multi-jointed hinge, f. the hinge (3*a*; 3*b*; 3*c*) comprises a first four-point joint (44, 50, 51, 47) articulated to the first fitting (64), to which a second four-point joint (50, 53, 55, 52) is articulated, to which in turn the second fitting (63) is articulated, g. the piston cylinder damping unit (6) is articulated to a central hinge arm (45) of the multi-jointed hinge via a joint (53), and h. the central hinge arm (45; 45*c*) is a component of the first four-point joint (44, 50, 51, 47) and of the second four-point joint (50, 53, 55, 52).

10. A hinge arrangement, comprising:

a. a first part (2), b. a second part (4) pivotably articulated to the first part (2) via a hinge (3; 3*a*; 3*b*; 3*c*), and c. a piston cylinder damping unit (6), i. which is operatively arranged between the first part (2) and the second part (4) for damping a pivoting movement of the two parts (2, 4) relative to one another, and ii. which is articulated to at least one of the first and the second part (2, 4), wherein d. a first fitting (64) and a second fitting (63) are connected to the first part (2) and to the second part (4), e. the hinge (3*a*; 3*b*; 3*c*) is a multi-jointed hinge, f. the hinge (3*a*; 3*b*; 3*c*) comprises a first four-point joint (44, 50, 51, 47) articulated to the first fitting (64), to which a second four-point joint (50, 53, 55, 52) is articulated, to which in turn the second fitting (63) is articulated, g. the piston cylinder damping unit (6) is articulated to a central hinge arm (45*c*) of the multi-jointed hinge, whereas said central hinge arm (45*c*) is outwardly extended by a portion (76) that is fastened by a journal (78) with the piston cylinder damping unit (6), and h. the central hinge arm (45; 45*c*) is a component of the first four-point joint (44, 50, 51, 47) and of the second four-point joint (50, 53, 55, 52).

11. A hinge arrangement, comprising:

a first part, connecting to a second fitting;

a second part, connecting to a first fitting, the second fitting is pivotably connected to the first fitting via a hinge; and a piston cylinder damping unit, connecting at least one of the first part and the second part and damping a pivot motion between the first and second part, wherein the hinge comprises, a central hinge arm, a support arm, a first intermediate arm, and a second intermediate arm, the central hinge arm and the support arm each connects to the first fitting, and the first intermediate arm, respectively, forming a first four-bar linkage, the first and second intermediate arms each connects to the central hinge arm and the second fitting, forming a second four-bar linkage, and one end of the first intermediate arm connects to a middle portion of the central hinge arm, and a middle portion of the first intermediate arm connects to one end of the support arm.

12. The hinge arrangement according to claim 11, further comprising:

a compression spring connecting middle portions of the first and second intermediate arms, respectively.

13. The hinge arrangement according to claim 11, wherein the first part is a refrigerator door and the second part is a refrigerator housing.

* * * * *